US012564216B2

(12) United States Patent
Younan

(10) Patent No.: US 12,564,216 B2
(45) Date of Patent: Mar. 3, 2026

(54) CIGAR ASHTRAY SYSTEM WITH COOLING

(71) Applicant: LGMYC Corporation, Woodland Hills, CA (US)

(72) Inventor: Zaya S. Younan, Woodland Hills, CA (US)

(73) Assignee: LGMYC Corporation, Woodland Hills, CA (US)

( * ) Notice: Subject to any disclaimer, the term of this patent is extended or adjusted under 35 U.S.C. 154(b) by 450 days.

(21) Appl. No.: 18/457,905

(22) Filed: Aug. 29, 2023

(65) Prior Publication Data

US 2025/0072485 A1 Mar. 6, 2025

(51) Int. Cl.
*A24F 19/10* (2006.01)
*A24F 19/00* (2006.01)

(52) U.S. Cl.
CPC ..... *A24F 19/10* (2013.01); *A24F 19/0035* (2013.01); *A24F 19/0078* (2013.01)

(58) Field of Classification Search
None
See application file for complete search history.

(56) References Cited

U.S. PATENT DOCUMENTS 1,699,160 A * 1/1929 Roos ..... A24F 19/145 131/236
4,534,369 A 8/1985 Jenkins
9,565,875 B2 2/2017 Ashjaee

FOREIGN PATENT DOCUMENTS

GB 190113050 A * 5/1902

* cited by examiner

*Primary Examiner* — Michael J Felton
(74) *Attorney, Agent, or Firm* — Crowell & Moring LLP

(57) ABSTRACT

A cigar-cooling ashtray system is configured for cooling a lit cigar between puffs, preferably to keep at least a body length of the cigar in an ambient temperature range around 65-70 degrees Fahrenheit. The system includes an upper unit with a central ash receptacle and a raised rim around the central ash receptacle, where at least one thermally-conductive region of the raised rim is lower than a tallest portion of the rim and is positioned and contoured to hold and maintain sufficient surface contact with the cigar to keep its lit end suspended above the central ash receptacle. A base comprising at least one cooling chamber is removably attachable to the upper unit, where the cooling chamber is in thermal communication with the thermally-conductive region of the raised rim when the base is attached thereto. An attachable/removable secondary base may be included to provide storage and/or aesthetic enhancement.

20 Claims, 11 Drawing Sheets

CIGAR ASHTRAY SYSTEM WITH COOLING

TECHNICAL FIELD

Embodiments disclosed herein generally relate to a cigar ashtray. More particularly, the cigar ashtray disclosed includes structure for cooling a cigar during consumption, as well as structure for storage.

BACKGROUND

Cigar smoking as a recreational activity has increased in many areas in recent years. During normal consumption by smoking, the mainstream aerosol from the burning distal end heats up the body of the cigar in a manner that may reduce a desired flavor and/or other sensory profile. This is particularly true in larger-diameter cigars. As such, it is desirable to maintain at least a length of the body of the cigar around an ambient temperature (e.g., of about 65-70 degrees Fahrenheit) while smoking.

It may further be desirable to provide this cooling function in conjunction with a place to rest cigar(s) between puffs, and to discard ash, along with an aesthetically-pleasing device appearance that also provides additional functionality.

BRIEF SUMMARY

One general aspect of embodiments disclosed herein includes a cigar ashtray system. The cigar ashtray system also includes a first element including a thermally-conductive platform with an upward-facing resting surface for at least one cigar; and an ash receptacle; a second element disposable in removable engagement with the first element, where the second element includes a cooling element, a first chamber for receiving a cooling element, or both; and where, when the second element is engaged with the first element, the engagement provides thermal communication between the resting surface and the second element. The system includes at least one second chamber.

Implementations of various embodiments may include one or more of the following features. The cigar ashtray system may include the at least one second chamber being disposed in a third element configured to engage one or both of the first element and second element. The cigar ashtray system's at least one second chamber may include a plurality of chambers. The cigar ashtray system's plurality of chambers may include chambers contoured and dimensioned for holding one or more of a cigar cutter, a lighter, a cigar, and a plurality of cigars. The cigar ashtray system's second chamber may be disposed in the second element. The cigar ashtray system may be configured so that the second chamber is disposed coaxially around the first chamber, or the first chamber is disposed coaxially around the second chamber.

The cigar ashtray system's second chamber may include a plurality of chambers and be disposed in the second element. In the cigar ashtray system, when at least one cigar is disposed in thermal communication (via the thermally-conductive platform with an upward-facing resting surface) with a selected one of the cooling element, first chamber for receiving a cooling element, or both, the system is configured to provide a non-burning body length of a lit cigar disposed upon that surface at a temperature of 65 to 70 degrees Fahrenheit (18 to 21 degrees Celsius), or—in some embodiments—at least within a broader temperature range of 70 degrees Fahrenheit±10 degrees Fahrenheit (21 degrees Celsius±6 degrees Celsius). The preferred temperature range will be well below the about 90 degrees Fahrenheit (or hotter) that a cigar can often reach, which reduces a desired flavor profile and/or desired mouthfeel for many or even most cigar users. As such, providing this system as an accessory will help those users obtain better value and enjoyment from a cigar.

When present in the cigar ashtray system, the cooling element may be selected from one or more of ice, a chilled liquid, a cooled or frozen gel, a thermoelectric cooling unit, and a chilled solid mass. In certain embodiments, the upward-facing resting surface is located and dimensioned to hold a lit end of a cigar above the ash receptacle while maintaining surface-contact with a sufficient surface area of the upward-facing resting surface to reduce a contacted area's temperature below a temperature of a non-contacted area nearer the lit end of the cigar. In some embodiments, the first element is constructed of materials including one or more stone, metal, heat-resistant thermo-conductive polymer, and/or any other material that will be safe for use in an ashtray while also providing the heat-conduction/cooling functionality described herein.

Another general aspect includes a cigar-cooling ashtray system configured for cooling a lit cigar between puffs. The cigar-cooling ashtray system also includes an upper unit including a central ash receptacle and a raised rim around the central ash receptacle; at least one thermally-conductive region of the raised rim being lower than a tallest portion of the rim and being positioned and contoured to hold and maintain sufficient surface contact with at least one cigar to keep a lit end suspended above the central ash receptacle; and a base removably attachable to the upper unit, the base may include at least one cooling chamber including and/or configured to receive a cooling unit or material, where the cooling chamber is in thermal communication with the at least one thermally-conductive region of the raised rim when the base is attached. Implementations may include one or more of the following features. The cigar cooling ashtray system may include at least a second base element removably attachable to the base. The cigar cooling ashtray system where the second base element may include one or more storage compartments. The cigar cooling ashtray system where the at least one cooling chamber may include a plurality of cooling chambers. A method of using the cigar cooling ashtray system may include steps of: placing a cooling unit or material into the at least one cooling chamber; attaching the base to the upper unit so that the cooling unit or material is in thermal communication with the at least one thermally-conductive region of the raised rim of the upper unit; lighting a cigar; and resting the lit cigar, between puffs, on the at least one thermally-conductive region of the raised rim in a manner allowing for cooling of a non-lit portion of the cigar.

DETAILED DESCRIPTION

Figure 1:
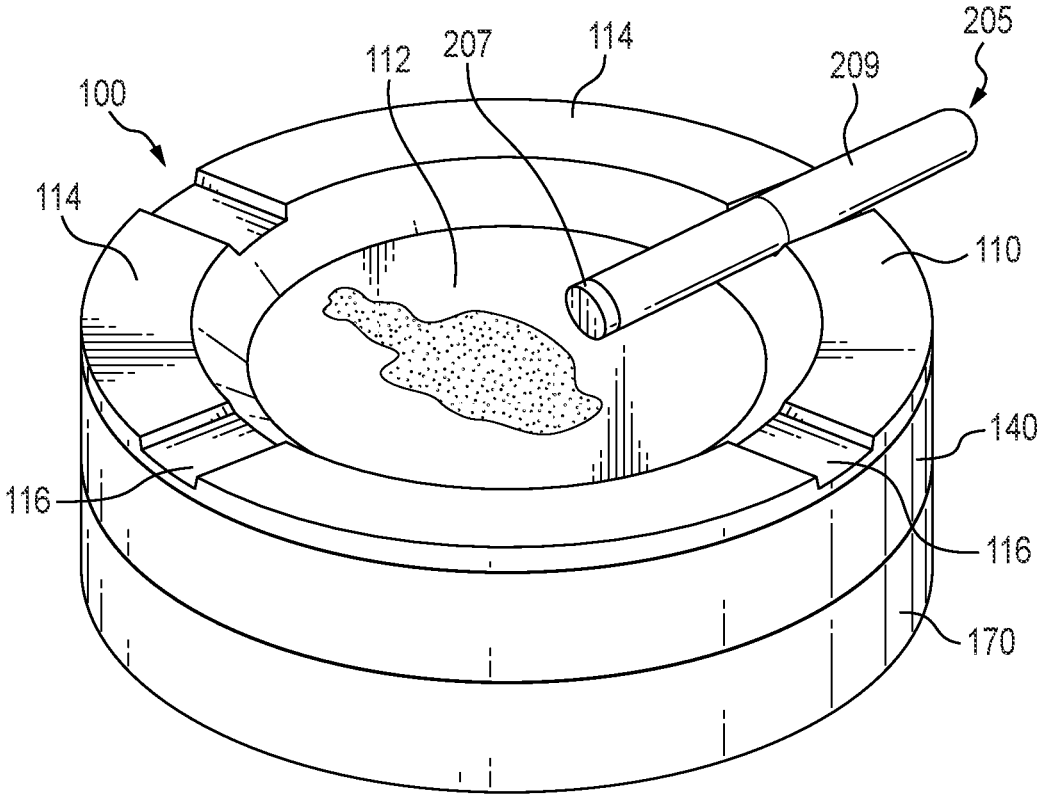
FIG. 1 shows a perspective view of a cigar ashtray system including a cigar.
Figure 1A:
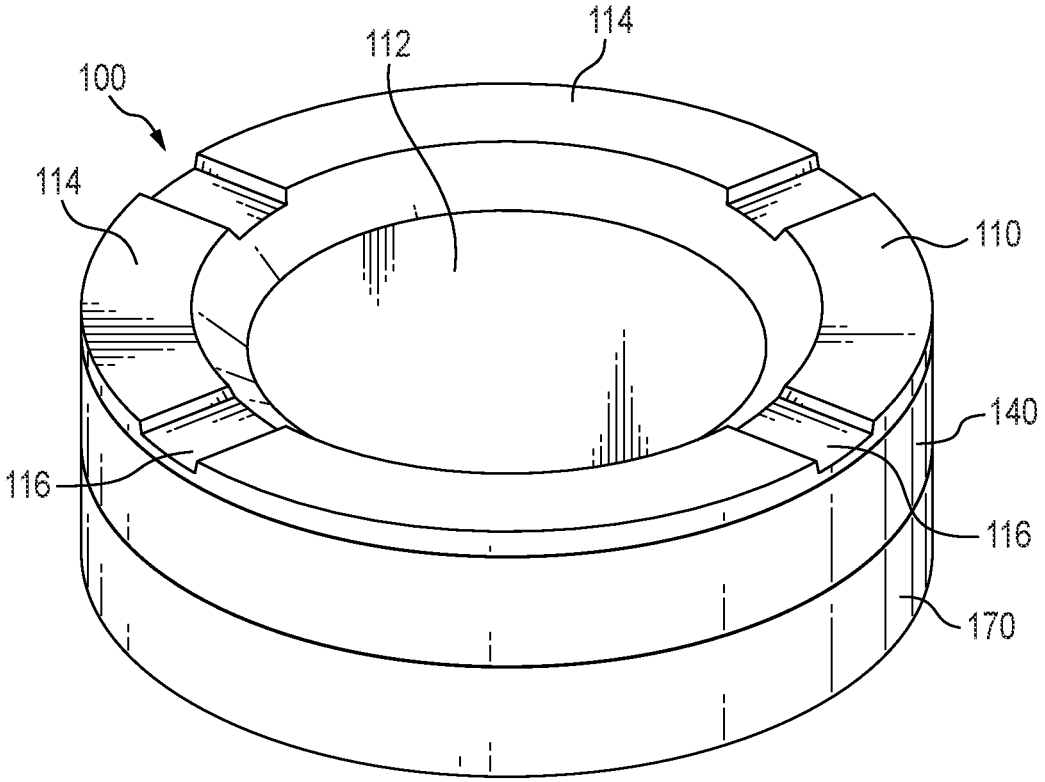
FIG. 1A shows the cigar ashtray system of FIG. 1 without the cigar.

Various embodiments are described below with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly.

Embodiments of the ashtray system include at least two engageable/separable elements of an upper ashtray and a lower cooling component, with some embodiments further including one or more other engageable/separable components, such as a base that may optionally include storage compartments for—by way of non-limiting example—cigars, food, lighter, cigar cutter, humidity control unit, or other object(s).

The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise. Reference herein to any industry standards (e.g., ASTM, ANSI, IEEE standards) is defined as complying with the currently published standards as of the original filing date of this disclosure concerning the units, measurements, and testing criteria communicated by those standards unless expressly otherwise defined herein.

The terms "upper/top" and "lower/bottom" are used herein in the common usage sense where they refer, respectively, to the side of an ashtray upon which one would typically rest a cigar, and the opposite side. The terms "about," "substantially," "generally," and other terms of degree, when used with reference to any volume, dimension, proportion, or other quantitative or qualitative value, are intended to communicate a definite and identifiable value within the standard parameters that would be understood by one of skill in the art (equivalent to a product design engineer with experience in any relevant field including cigar/cigarette art and accessories), and should be interpreted to include at least any legal equivalents, minor but functionally-insignificant variants, standard manufacturing tolerances, and including at least mathematically significant figures (although not required to be as broad as the largest range thereof). The word "configured" requires particular physical structure with regard to absolute or relative dimensions and/or position, and is not meant in an aspirational or "intended use" sense. "Cigar" is used in the standard sense to refer to a smoking article configured as a tubular roll of tobacco, typically including a core bound together by a leaf with the whole being encased in another leaf of smooth and even texture. Although cigars vary significantly in size (length and diameter), as well as with regard to specific heating, combustion, air-draw, and other properties, the presently-disclosed embodiments are not limited by those variations. Also, even though the system shown and described has a columnar appearance with a circular boundary, it should be appreciated that its appearance, including the appearance of each of its constituent parts, may be changed to have a different ornamental appearance (e.g., different geometric periphery that is symmetrical or asymmetrical, or other configuration, such as being square, rectangular, hexagonal, or octagonal, with sharp corners and/or edges, rounded corners and/or edges), without altering the functional features described and claimed herein.

Embodiments of a cigar ashtray system 100, with cooling features, are described with reference to FIGS. 1-4C. The system 100 includes three primary components: an uppermost ashtray element 110, a central/middle cooler tray element 140, and a storage base 170. Bottom views of the components are not shown, but are unornamented and are not relied upon for any claimed structure or functions. For example, those of skill in basic mechanical arts will understand that the components described as engaging together may do so using any number of basic structures including lip/groove, magnetic, threaded, or other engagement structures that do not need to be illustrated in order to be practiced with reference to the state of the art and the present disclosure. The base 170 may be omitted in certain embodiments, and it may engage directly and/or indirectly with each of the ashtray element 110 and the cooler tray 140.

The ashtray element 110 includes a central ash receptacle area 112 and a raised rim 114 disposed around (and preferably elevated above) a periphery of the ash receptacle area 112. The raised rim 114 includes at least one depression 116 which may be rectilinear, curved, or any combination thereof, and preferably includes a plurality of depressions 116. FIG. 1 is shown with a lit cigar 205 resting upon the system, with a lit/burning distal end 207 and a body 209 (of which a portion contacts a depression 116 of the rim 114. The depressions 116 may be made of the same material as (and may be of one continuous piece with) the rim 114 and the ash receptacle area 112. Or, the depressions 116 may be made of a different material. Suitable materials for the depressions 116 (and/or the rest of the ashtray element 110) may include one or more of stone, metal, and heat-resistant thermo-conductive polymer(s). As such, the depressions 116 at least include one thermo-conductive material that will absorb/transmit heat away from a cigar (e.g., the cigar 205 shown in FIG. 1).

Figure 2:
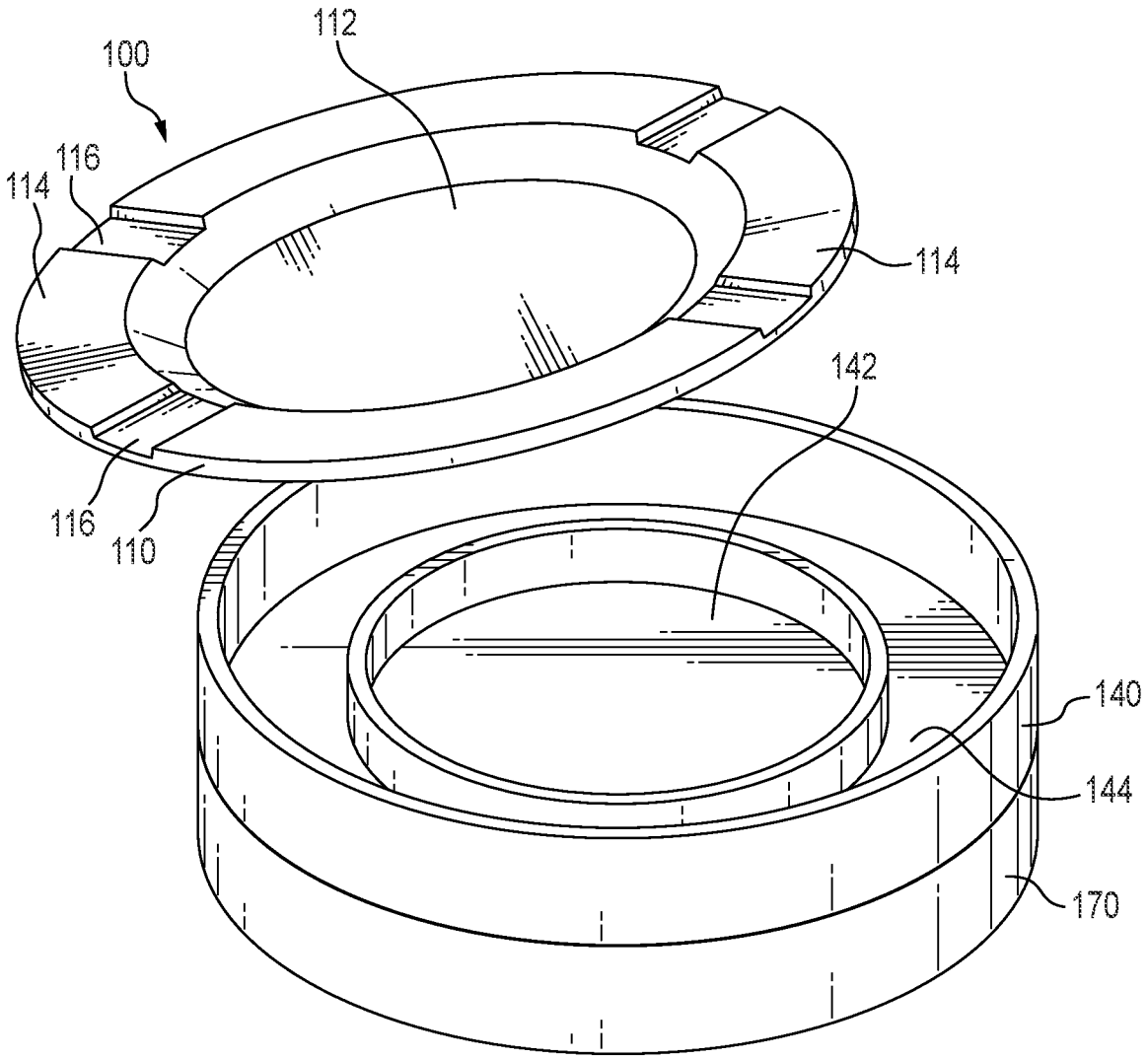
FIG. 2 shows the cigar ashtray system, with the uppermost ashtray element set aside to reveal a double cooling chamber engaged atop a base.
Figure 2A:
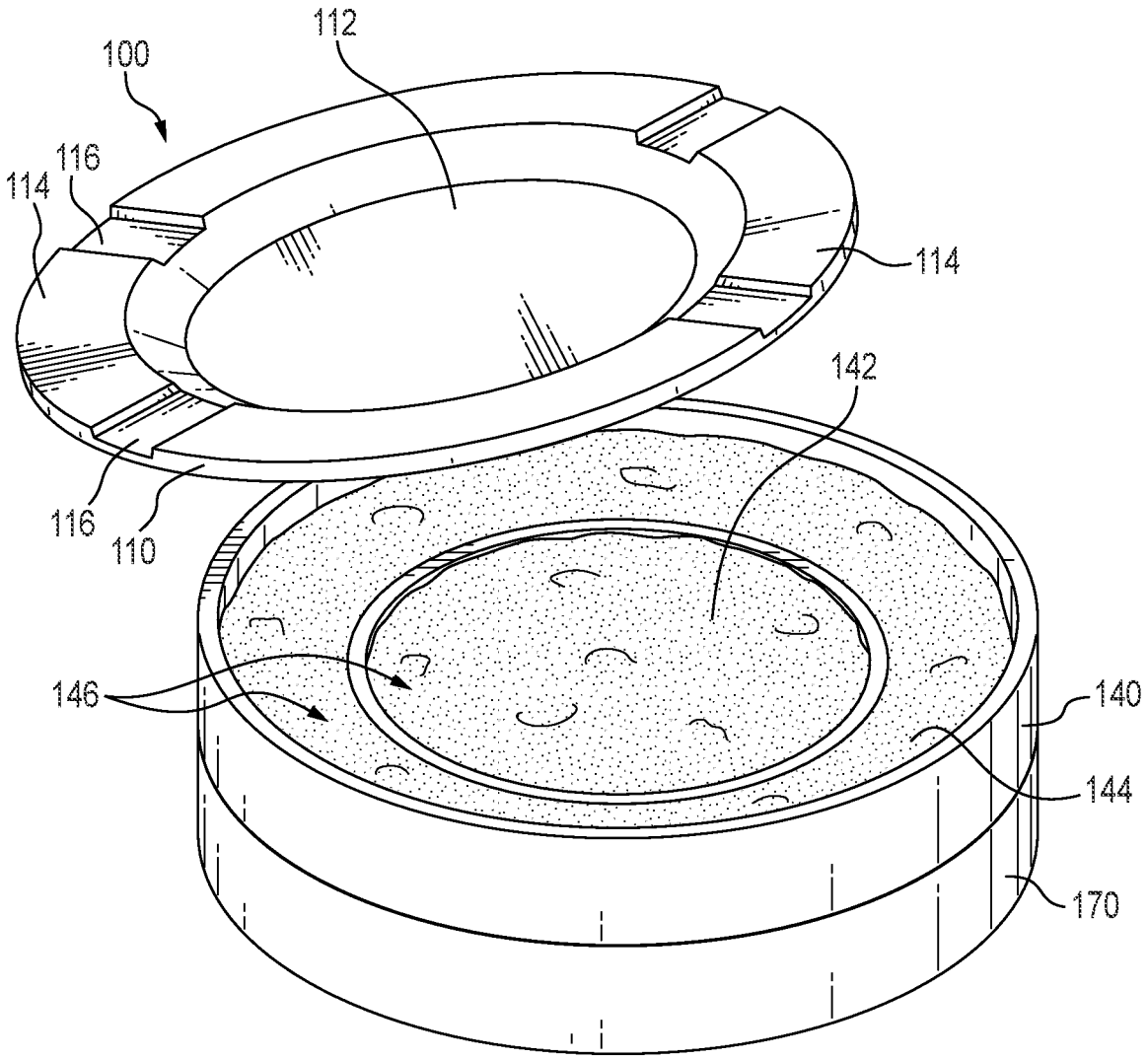
FIG. 2A shows the cigar ashtray system of FIG. 2, with cooling material occupying both portions of the double cooling chamber.
Figure 2B:
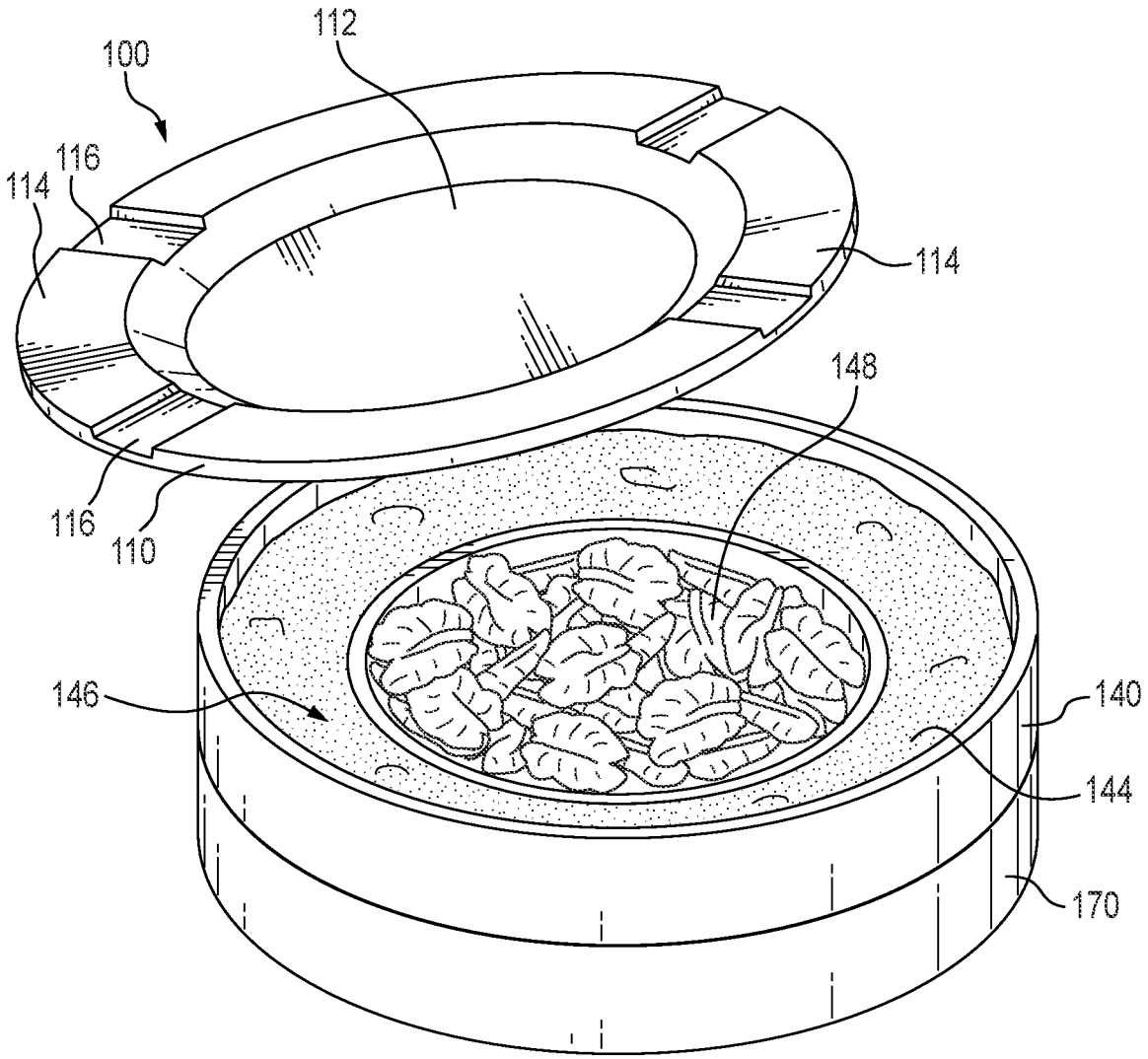
FIG. 2B shows the cigar ashtray system of FIG. 2, with cooling material occupying one portion and another material (e.g., food) occupying the other portion of the double cooling chamber.
Figure 3:
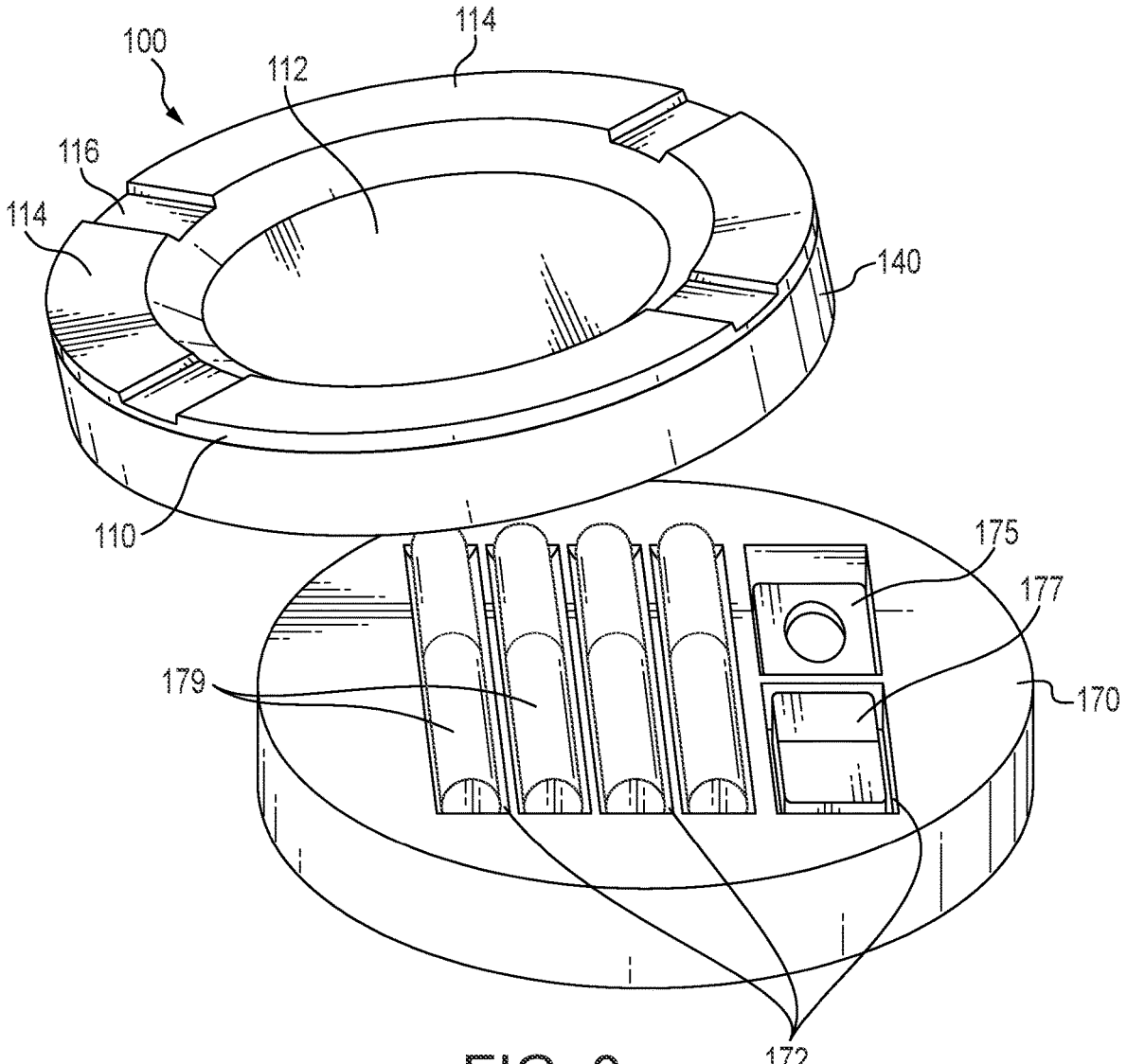
FIG. 3 shows the cigar ashtray system, with the cooling chamber engaged to the uppermost ashtray element and separated from the base, which includes chambers for storing items (e.g., cigars, lighter, cigar cutter, humidity-control element(s), some of which are shown by way of non-limiting example)
Figure 3A:
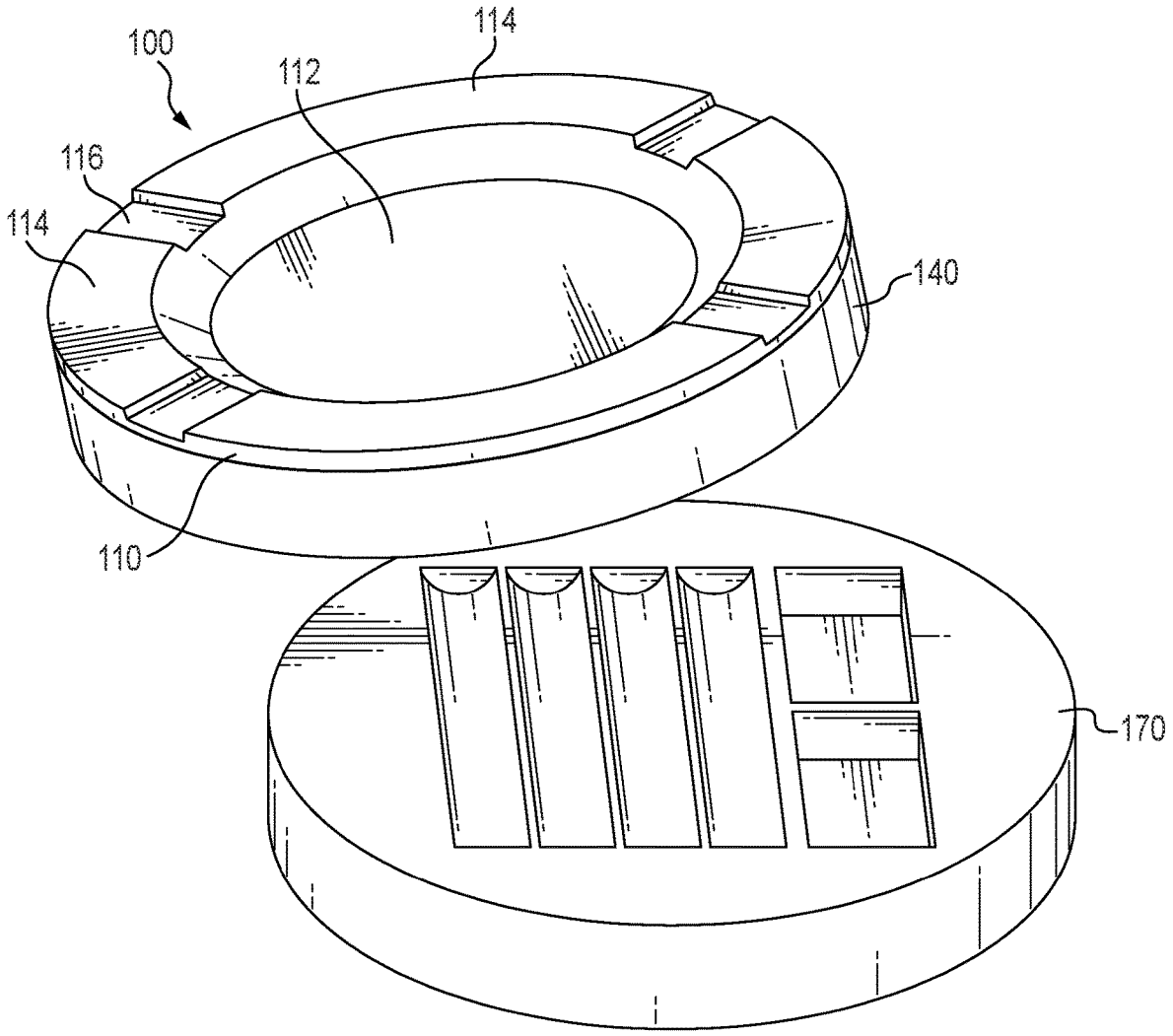
FIG. 3A shows the cigar ashtray system of FIG. 3, with the cooling chamber engaged to the uppermost ashtray element and separated from the base, which includes chambers for storing items (shown unoccupied, although the shape, size, and aesthetic appearance and layout may be changed while providing desired functional aspects of the system)
Figure 4:
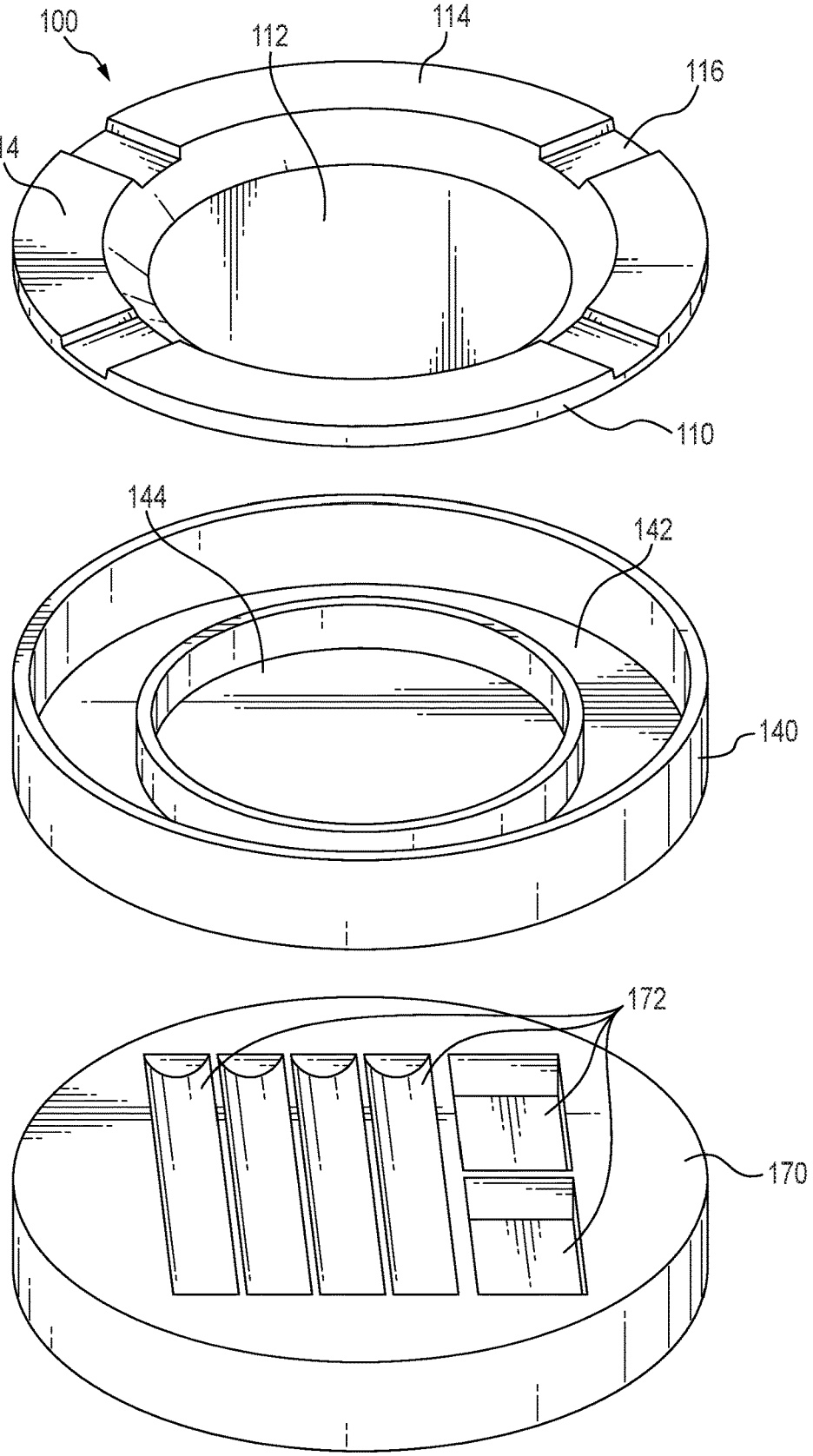
FIG. 4 is an exploded perspective view of a cigar ashtray system of FIG. 1.
Figure 4A:
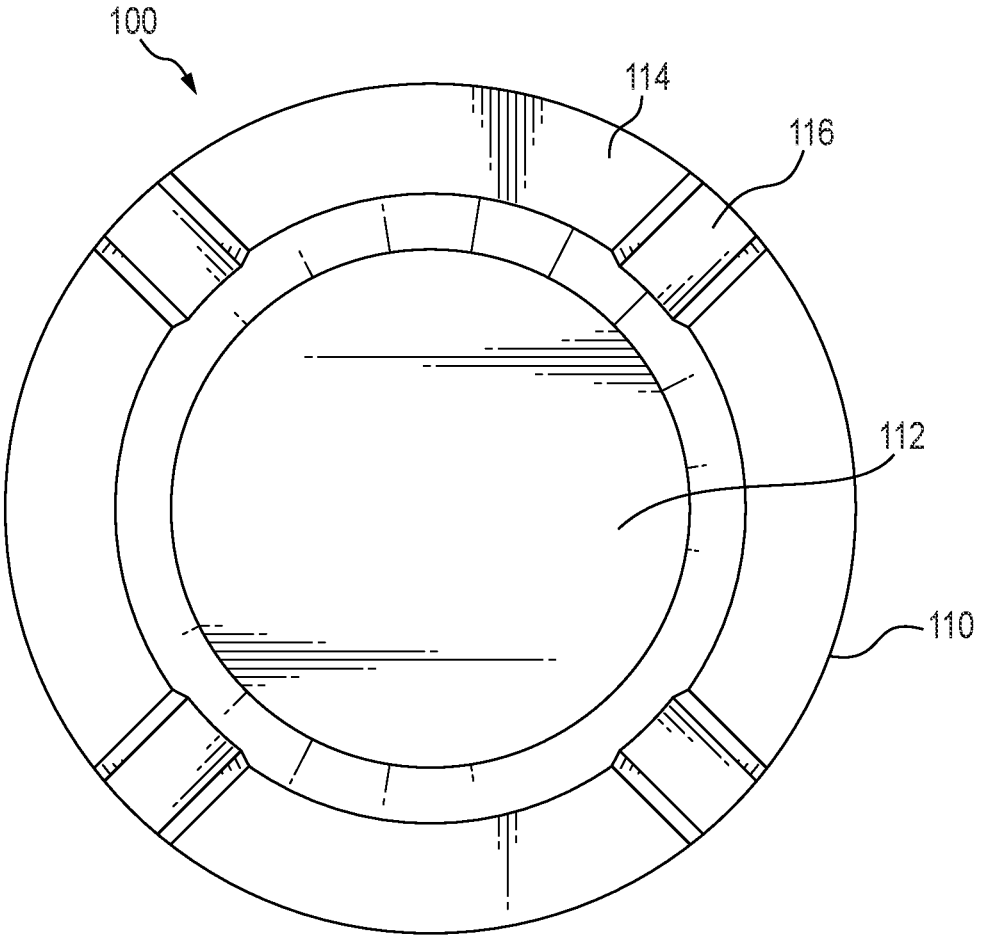
FIG. 4A is a top-down plan view of the cigar ashtray system (same, whether assembled or exploded/disassembled)
Figure 4B:
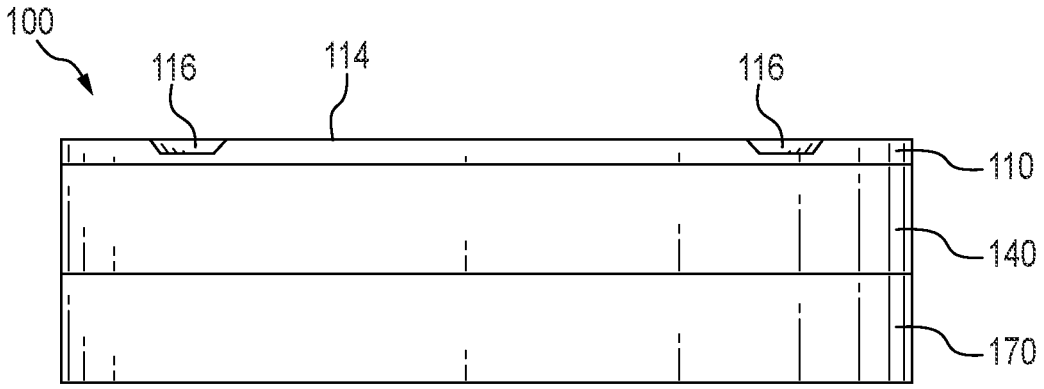
FIG. 4B is a side elevation view of the cigar ashtray system (assembled), for which the other three side views at 90-degree intervals would look the same.
Figure 4C:
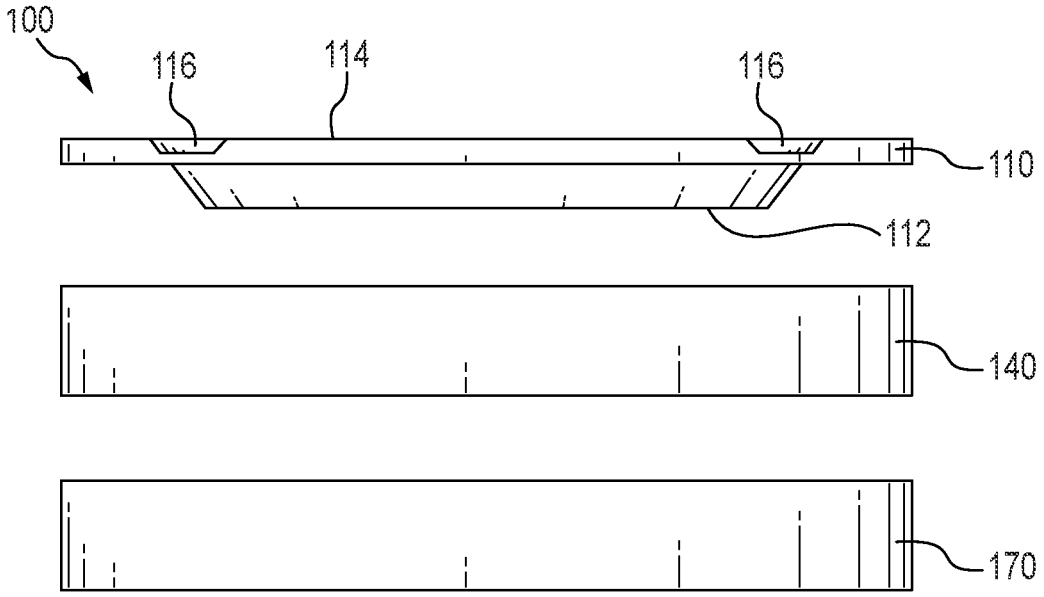
FIG. 4C is a side elevation view of the cigar ashtray system (exploded), for which the other three side views at 90-degree intervals would look the same.

FIGS. 2, 2A, 2B, and 4 show a cooling tray 140 (which may function as the sole base, or as a primary base), with FIG. 2 showing the cooling tray unoccupied by other materials. In the embodiment shown, the cooling tray 140 includes a central chamber 142 coaxially surrounded by an outer chamber 144. However, other embodiments may include only a single chamber, or may include some other plurality of chambers, although preferred embodiments will have at least one chamber configured to align or otherwise be in thermal communication with each depression 116 of the ashtray element 110 for providing heat-absorption/cooling thereto. FIG. 2A shows both chambers 142, 144 filled with at least one cooling element or material 146 (e.g., ice, chilled liquid, cooled or frozen gel, thermoelectric cooling unit(s), chilled solid mass(s) such as a stone or ceramic, or any other appropriate material that may be cooled and thereby serve as an effective means for cooling the depression(s) 116 and a cigar resting thereupon). In another embodiment, the cooling tray may not have an open area/chamber as shown but may include one or more built-in cooling elements such as, by way of non-limiting example, thermoelectric or other cooling unit(s), gel or other material that can be cooled (e.g., by placing on ice, in a refrigerator or freezer), which is not expressly illustrated because those of even basic mechanical skill will readily comprehend that such structure may replace one or more of chambers 142, 144 and/or material 146 in FIG. 2A. For embodiments with a plurality of chambers 142, 144, etc., one or more such chambers may be used to hold food, beverage, or other items 148 (e.g., as in FIG. 2B) that may benefit from cooling and also may provide convenience to a user.

The depression 116 preferably is dimensioned, positioned, and contoured to hold and maintain sufficient surface contact with at least one cigar to cool a length of the cigar body below a default temperature that is also below the temperature of the lit end and below the temperature of a non-depression-contacting cigar body region nearer the lit end. Certain embodiments may also be configured to keep a lit end suspended above the central ash receptacle. In some embodiments, the combination of the ashtray element 110 and cooling tray 140 with cooler 146 will provide a non-burning body length of a lit cigar disposed upon that surface being cooled to a temperature of 70 degrees Fahrenheit±10 degrees Fahrenheit (21 degrees Celsius±6 degrees Celsius), or will at least provide a non-burning body length of a lit cigar disposed upon that surface to a temperature of 65 to 70 degrees Fahrenheit (18 to 21 degrees Celsius).

As shown in FIGS. 1, 3, 3A, and 4B-4C, a storage base 170 aligns with and removably engages the cooling tray 140. The storage base 170 may include one or a plurality of chambers 172 contoured and dimensioned for holding—by way of non-limiting example—one or more of a cigar cutter 175, a lighter 177, a cigar, and a plurality of cigars 179 as shown in the exemplary image of FIG. 3. Although the size and position of those chambers are shown in a particular configuration, it will be appreciated that the same storage function may be accomplished with a different layout of the same-shaped (or differently-shaped) chambers, or other storage functionality may be provided with different numbers and/or shapes of chambers.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation unless specifically defined by context, usage, or other explicit designation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment. In the event of any inconsistent disclosure or definition from the present application conflicting with any document incorporated by reference, the disclosure or definition herein shall be deemed to prevail.

I claim:

1. A cigar ashtray system, comprising:

a first element including a thermally-conductive platform with an upward-facing resting surface for at least one cigar; and an ash receptacle;

a second element disposable in removable engagement with the first element, where the second element includes a cooling element, a first chamber configured for including a cooling element, or both; and where, when the second element is engaged with the first element, the engagement provides for thermal communication between the resting surface and the cooling element in a manner configured to cool at least a portion of a cigar disposed on the resting surface and encloses the cooling element separating the cooling element from the up-ward facing surface and the ash receptacle; and at least one second chamber.

2. The cigar ashtray system of claim 1, where the at least one second chamber is disposed in a third element configured to engage one or both of the first element and the second element.

3. The cigar ashtray system of claim 2, where the at least one second chamber includes a plurality of chambers.

4. The cigar ashtray system of claim 3, where the plurality of chambers includes chambers contoured and dimensioned for holding one or more of a cigar cutter, a lighter, a cigar, and a plurality of cigars.

5. The cigar ashtray system of claim 1, where the at least one second chamber includes a plurality of chambers.

6. The cigar ashtray system of claim 1, where the second chamber is disposed in the second element.

7. The cigar ashtray system of claim 6, where the second chamber is disposed coaxially around the first chamber, or the first chamber is disposed coaxially around the second chamber.

8. The cigar ashtray system of claim 1, where the second chamber includes a plurality of chambers and is disposed in the second element.

9. The cigar ashtray system of claim 8, where at least one of the plurality of chambers is configured for storing food and/or beverage and is in thermal communication with the cooling element, the first chamber for receiving a cooling element, or both.

10. The cigar ashtray system of claim 1, where the thermally-conductive platform with an upward-facing resting surface for at least one cigar—when in thermal communication with a selected one of the cooling element, the first chamber for receiving a cooling element, or both—is configured to provide a non-burning body length of a lit cigar disposed upon that surface in a temperature range of 60 to 80 degrees Fahrenheit (15 to 27 degrees Celsius).

11. The cigar ashtray system of claim 1, where the thermally-conductive platform with an upward-facing resting surface for at least one cigar—when in thermal communication with a selected one of the cooling element, the first chamber for receiving a cooling element, or both—is configured to provide a non-burning body length of a lit cigar disposed upon that surface in a temperature range of 65 to 70 degrees Fahrenheit (18 to 21 degrees Celsius).

12. The cigar ashtray system of claim 1, where—when present—the cooling element is selected from one or more of ice, a chilled liquid, a cooled or frozen gel, a thermoelectric cooling unit, and a chilled solid mass.

13. The cigar ashtray system of claim 1, where the upward-facing resting surface is located and dimensioned to hold a lit end of a cigar above the ash receptacle while maintaining surface-contact with a sufficient surface area of the upward-facing resting surface to reduce a contacted area's temperature below a temperature of a non-contacted area nearer the lit end.

14. The cigar ashtray system of claim 1, where the first element is constructed of materials including one or more of stone, metal, and heat-resistant thermo-conductive polymer.

15. A cigar-cooling ashtray system configured for cooling a lit cigar between puffs, the system comprising:

an upper unit including a central ash receptacle and a raised rim around the central ash receptacle;

at least one thermally-conductive region of the raised rim being lower than a tallest portion of the rim and being positioned and contoured to hold and maintain sufficient surface contact with at least one cigar to keep a lit end suspended above the central ash receptacle; and a base removably attachable to the upper unit, the base comprising at least one cooling chamber including and/or configured to receive a cooling unit or material, where the cooling chamber is in thermal communication with the at least one thermally-conductive region of the raised rim when the base is attached.

16. The cigar cooling ashtray system of claim 15, further comprising at least a second base element removably attachable to the base.

17. The cigar cooling ashtray system of claim 16, where the second base element includes one or more storage compartments.

18. The cigar cooling ashtray system of claim 15, where the at least one cooling chamber comprises a plurality of cooling chambers.

19. A method of using the cigar cooling ashtray system of claim 15, said method comprising steps of:

placing a cooling unit or material into the at least one cooling chamber;

attaching the base to the upper unit so that the cooling unit or material is in thermal communication with the at least one thermally-conductive region of the raised rim of the upper unit;

lighting a cigar; and resting the lit cigar, between puffs, on the at least one thermally-conductive region of the raised rim in a manner allowing for cooling of a non-lit portion of the cigar.

20. The method of claim 19, where the system further comprises at least a second base element removably attachable to the base, and the method further comprises one or more of:

adding and/or removing food from a storage compartment of the second base element;

rotating the cigar to rest a different side on the at least one thermally-conductive region between successive puffs; and adding or removing cooling material, and/or adjusting a cooling unit if present, to adjust the at least one thermally-conductive region to a desired temperature.

* * * * *